US008048348B2

(12) United States Patent
Duan et al.

(10) Patent No.: US 8,048,348 B2
(45) Date of Patent: Nov. 1, 2011

(54) SHAPE MEMORY POLYURETHANE FOAM FOR DOWNHOLE SAND CONTROL FILTRATION DEVICES

(75) Inventors: Ping Duan, Spring, TX (US); Paul McElfresh, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/048,374

(22) Filed: Mar. 15, 2011

(65) Prior Publication Data

US 2011/0162780 A1 Jul. 7, 2011

Related U.S. Application Data

(62) Division of application No. 12/250,062, filed on Oct. 13, 2008, now Pat. No. 7,926,565.

(51) Int. Cl.
*B29C 39/18* (2006.01)

(52) U.S. Cl. ..... 264/48; 166/278; 166/51

(58) Field of Classification Search ..... 166/51, 166/278; 264/40.21, 48
See application file for complete search history.

(56) References Cited

U.S. PATENT DOCUMENTS

| | | | | |
|---|---|---|---|---|
| 4,148,734 | A * | 4/1979 | Hilterhaus et al. | 264/48 |
| 5,910,357 | A | 6/1999 | Hachisuka et al. | |
| 6,043,290 | A | 3/2000 | Petrella | |
| 6,103,851 | A | 8/2000 | Roser et al. | |
| 6,566,482 | B2 | 5/2003 | Haas et al. | |
| 6,583,194 | B2 | 6/2003 | Sendijarevic | |
| 6,613,864 | B1 | 9/2003 | Porter et al. | |
| 6,964,626 | B1 | 11/2005 | Wu et al. | |
| 7,013,979 | B2 | 3/2006 | Richard | |
| 7,048,048 | B2 | 5/2006 | Nguyen et al. | |
| 7,160,455 | B2 * | 1/2007 | Taniguchi et al. | 210/321.88 |
| 7,318,481 | B2 | 1/2008 | Richard | |
| 7,392,852 | B2 | 7/2008 | Richard | |
| 7,708,073 | B2 | 5/2010 | Richard et al. | |
| 7,743,835 | B2 | 6/2010 | Willauer | |
| 2004/0178136 | A1 * | 9/2004 | Taniguchi et al. | 210/321.79 |
| 2005/0253288 | A1 | 11/2005 | Gross et al. | |
| 2007/0202770 | A1 * | 8/2007 | Penalva | 442/337 |

(Continued)

OTHER PUBLICATIONS

Abstract of H. Tobushi et al.; "Thermomechanical Properties of Polyurethane-Shape Memory Polymer Foam," 11th ICAST: International Conference on Adaptive Structures and Technologies, Nagoya, Japan, 2001, vol. 12, No. 4, pp. 283-287. (available from http://cat.inist.fr!?Modele+afficheN&cpsidt+13872499).

Abstract of S. H. Lee et al.; "Shape Memory Effects of Molded Flexible Polyurethane Foam," Smart Materials and Structures, Oct. 23, 2007, vol. 16, pp. 2486-2491 ( (available from http://www.iop.org/EJ/abstractl0964-1726/16/052).

*Primary Examiner* — William P Neuder
(74) *Attorney, Agent, or Firm* — Mossman Kumar & Tyler PC

(57) ABSTRACT

Filtration devices may include a shape-memory material having a compressed run-in position or shape and an original expanded position or shape. The shape-memory material may include an open cell porous rigid polyurethane foam material held in the compressed run-in position at the temperature below glass transition temperature ($T_g$). The foam material in its compressed run-in position may be covered with a fluid-dissolvable polymeric film and/or a layer of fluid-degradable plastic. Once filtration devices are in place in downhole and are contacted by the fluid for a given amount of time at temperature, the devices may expand and totally conform to the borehole to prevent the production of undesirable solids from the formation.

19 Claims, 1 Drawing Sheet

U.S. PATENT DOCUMENTS

2007/0240877 A1 10/2007 O'Malley et al.
2008/0296020 A1 12/2008 Willauer
2009/0000793 A1 1/2009 Guillot et al.
2009/0133810 A1* 5/2009 Penalva ..... 156/148

* cited by examiner

SHAPE MEMORY POLYURETHANE FOAM FOR DOWNHOLE SAND CONTROL FILTRATION DEVICES

CROSS-REFERENCE TO RELATED APPLICATION

This application is a divisional of U.S. Ser. No. 12/250,062 filed Oct. 13, 2008, issued Apr. 19, 2011 as U.S. Pat. No. 7,926,565.

TECHNICAL FIELD

The present invention relates to filtration devices used in oil and gas wellbores to prevent the production of undesirable solids from the formation, and more particularly relates to filtration devices having shape-memory porous materials that remain in a compressed state during run-in; once the filtration devices are in place downhole and are contacted by a fluid for a given amount of time at temperature, the devices can expand and totally conform to the borehole.

TECHNICAL BACKGROUND

Various sand control methods by gravel packing outside of down-hole screens are known in the art. Gravels are introduced from the surface to fill the annular space between outside the screen and the inner wall surface of a wellbore to prevent the production of undesirable solids from the formation. More recently, it was thought that the need for gravel packing could be eliminated if a screen or screens could be expandable to the inner wall surface of a wellbore. Problems arose with the screen expansion technique as a replacement for gravel packing because of wellbore shape irregularities. U.S. Pat. No. 7,013,979 disclosed a totally conforming expandable screen to conform the borehole irregular shape. This conforming expandable screen consists of a self-swelling material that is capable of expansion of its volume by contacting well fluids. U.S. Pat. No. 7,318,481 disclosed a self-conforming expandable screen which comprises of thermosetting open cell shape-memory polymeric foam. The foam material composition is formulated to achieve the desired transition temperature slightly below the anticipated downhole temperature at the depth at which the assembly will be used. This causes the conforming foam to expand at the temperature found at the desired depth, and to remain expanded against the borehole wall.

There are many types of polymeric foam commercially available such as natural rubber foam, vinyl rubber foam, polyethylene foam, neoprene rubber foam, silicone rubber foam, polyurethane foam, VITON® rubber foam, polyimide foam, etc. Most of these foams are cell-closed, soft and lack of structural strength to be used in the downhole conditions. Some of these foams such as rigid polyurethane foam are hard but very brittle. In addition, conventional polyurethane foams which are generally made from polyethers or polyesters lack thermal stability and the necessary chemical capabilities. Consequently these foams are undesirably quickly destroyed in the downhole fluids, especially at an elevated temperature.

It would thus be very desirable and important to discover a method and device for deploying an element at a particular location downhole to prevent the production of undesirable solids from the formation and allow only the desired hydrocarbon fluids to flow through.

SUMMARY

There is provided, in one form, a wellbore filtration device that involves a shape-memory porous material. The shape-memory porous material has a compressed position and an expanded position. The shape-memory porous material is maintained in its compressed position at a temperature below its glass transition temperature. The shape-memory porous material expands from its compressed position to its expanded position when it is heated to a temperature above its glass transition temperature.

In another non-limiting embodiment there is provided a method of manufacturing a wellbore filtration device. The method involves mixing an isocyanate portion that contains an isocyanate with a polyol portion that contains a polyol to form an open-cell polyurethane foam material. The open-cell polyurethane foam material has an original expanded volume. The polyurethane foam material is compressed at a temperature above its glass transition temperature $T_g$ to reduce the original expanded volume to a compressed run-in volume. The temperature of the compressed polyurethane foam material is lowered to a temperature below $T_g$, but the polyurethane foam material maintains its compressed run-in volume. The method further comprises covering the outer surface of the compressed polyurethane foam material with a covering that may be a fluid-dissolvable polymeric film and/or a layer of thermally fluid-degradable plastic.

Further there is provided in a different, non-restrictive version a method of installing a wellbore filtration device on a downhole tool in a formation. The method involves securing a downhole tool to a string of perforated tubing. The downhole tool has a filtration device with a shape-memory porous material. The shape-memory porous material has a compressed run-in position and an original expanded position. The shape-memory porous material is maintained in the compressed run-in position below a glass transition temperature of the shape-memory porous material. The shape-memory porous material in its compressed run-in position has an outer surface with a covering. The covering may a fluid-dissolvable polymeric film and/or a layer of thermally fluid-degradable plastic. The downhole tool is run into a wellbore. The covering and the shape-memory porous material is contacted with a fluid. The covering is removed by the fluid. The shape-memory porous material expands from its compressed run-in position to an expanded position against the wellbore. In this way it serves a filtration function by preventing undesirable solids from being produced while permitting desirable hydrocarbons to flow through the filtration device.

Figure 1:
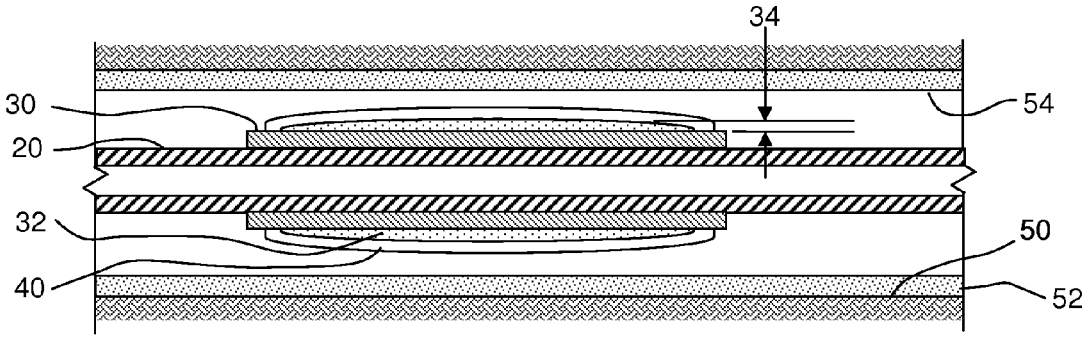
FIG. 1 is a schematic, cross-section view of a filtration device which bears a shape-memory porous material in its compressed, run-in thickness or volume, having thereover a degradable delaying film, covering or coating material.
Figure 2:
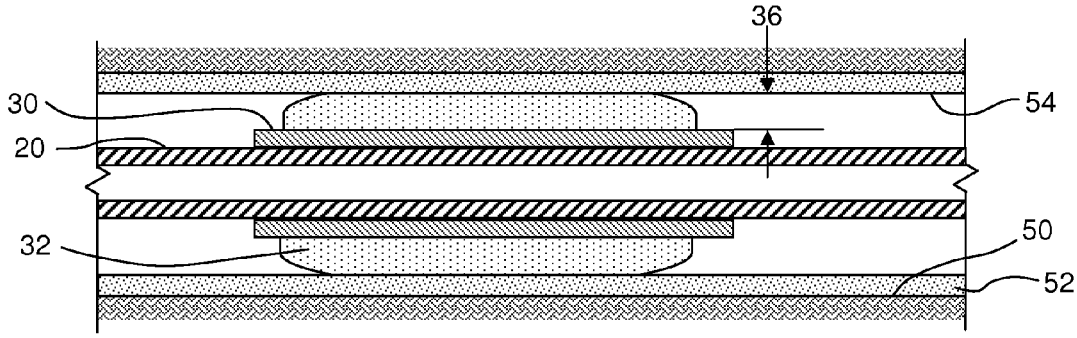
FIG. 2 is a schematic, cross-section view of the filtration device of FIG. 1 where the degradable delaying film, covering or coating material has been removed and the shape-memory porous material has been permitted to expand or deploy so that it firmly engages and fits to the inner wall surface of the wellbore casing to prevent the production of undesirable solids from the formation, allowing only hydrocarbon fluids to flow therethrough.

It will be appreciated that FIGS. 1 and 2 are simply schematic illustrations which are not to scale and that the relative sizes and proportions of different elements may be exaggerated for clarity or emphasis.

DETAILED DESCRIPTION

Downhole tools and, in particular, filtration devices for downhole sand control, are disclosed herein. The filtration devices include one or more shape-memory materials that are run into the wellbore in a compressed shape or position. The shape-memory material remains in the compressed shape induced on it after manufacture at surface temperature or at wellbore temperature during run-in. After the filtration device having the shape-memory material is placed at the desired location within the well, the shape-memory material is allowed to expand to its pre-compressed shape, i.e., its original, manufactured shape, at downhole temperature at a given amount of time. The expanded shape or set position, therefore, is the shape of the shape-memory material after it is manufactured and before it is compressed. In other words, the shape-memory material possesses hibernated shape-memory that provides a shape to which the shape-memory material naturally takes after its manufacturing when it is deployed downhole.

As a result of the shape-memory material being expanded to its set position, the completely open cell porous material can prevent production of undesirable solids from the formation and allow only desired hydrocarbon fluids to flow through the filtration device. The completely open cell porous material or foam is made in one non-limiting embodiment from one or more polycarbonate polyol and a modified diphenylmethane diisocyanate (MDI), as well as other additives including, but not necessarily limited to, blowing agents, molecular cross linkers, chain extenders, surfactants, colorants and catalysts. The foam cell pore size, size distribution and cell openness may be achieved by formulating different components and by controlling processing conditions in such a way that only desired hydrocarbon fluids are allowed to flow through and undesirable solids from the formation are prevented from being produced.

The shape-memory polyurethane foam material is capable of being mechanically compressed substantially, e.g., 2~30% of its original volume, at temperatures above its glass transition temperature ($T_g$) at which the material becomes soft. While still being compressed, the material is cooled down well below its $T_g$, or cooled down to room or ambient temperature, and it is able to remain at compressed state even after the applied compressive force is removed. When the material is heated near or above its $T_g$, it is capable of recovery to its original un-compressed state or shape. In other words, the shape-memory material possesses hibernated shape-memory that provides a shape to which the shape-memory material naturally takes after its manufacturing. The compositions of polyurethane foam are able to be formulated to achieve desired glass transition temperatures which are suitable for the downhole applications, where deployment can be controlled for temperatures below $T_g$ of filtration devices at the depth at which the assembly will be used.

Generally, polyurethane elastomer or polyurethane foam is considered poor in thermal stability and hydrolysis resistance, especially when it is made from polyether or polyester. It has been discovered herein that the thermal stability and hydrolysis resistance are significantly improved when the polyurethane is made from polycarbonate polyols and MDI diisocyanates. There are many polycarbonate polyols commercially available such as Desmophen C1200 and Desmophen 2200 from Bayer, Poly-CD 220 from Arch Chemicals, PC-1733, PC-1667 and PC-1122 from Stahl USA. In one non-limiting embodiment, the polycarbonate polyol PC-1667 or poly(cycloaliphatic carbonate) is suitable because it shows exceptional thermal and hydrolytic stability when it is used to make polyurethane. In addition, the polyurethane made from poly(cycloaliphatic carbonate) is hard and tough. The compositions of polyurethane foam are able to be formulated to achieve different glass transition temperatures within the range from 60° C. to 170° C., which is especially suitable to meet most downhole application temperature requirements.

In one specific non-limiting embodiment, the shape-memory material is a polyurethane foam material that is extremely tough and strong and that is capable of being compressed and returned to substantially its original expanded shape. The $T_g$ of the shape-memory polyurethane foam is about 94.4° C. and it is compressed by mechanical force at 125° C., in another non-limiting embodiment. While still in compressed state, the material is cooled down to room temperature. The shape-memory polyurethane foam is able to remain in the compressed state even after applied mechanical force is removed. When material is heated to about 88° C., it is able to return to its original shape within 20 minutes. However, when the same material is heated to a lower temperature such as 65° C. for about 40 hours, it remains in the compressed state and does not change its shape.

Ideally, when shape-memory polyurethane foam is used as a filtration media for downhole sand control applications, it is preferred that the filtration device remains in a compressed state during run-in until it reaches to the desired downhole location. Usually, downhole tools traveling from surface to the desired downhole location take hours or days. When the temperature is high enough during run-in, the filtration devices made from the shape-memory polyurethane foam could start to expand. To avoid undesired early expansion during run-in, delaying methods may or must be taking into consideration. In one specific, but non-limiting embodiment, poly(vinyl alcohol) (PVA) film is used to wrap or cover the outside surface of filtration devices made from shape-memory polyurethane foam to prevent expansion during run-in. Once filtration devices are in place in downhole for a given amount of time at temperature, the PVA film is capable of being dissolved in the water, emulsions or other downhole fluids and, after such exposure, the shape-memory filtration devices can expand and totally conform to the bore hole. In another alternate, but non-restrictive specific embodiment, the filtration devices made from the shape-memory polyurethane foam may be coated with a thermally fluid-degradable rigid plastic such as polyester polyurethane plastic and polyester plastic. By the term "thermally fluid-degradable plastic" is meant any rigid solid polymer film, coating or covering that is degradable when it is subjected to a fluid, e.g. water or hydrocarbon or combination thereof and heat. The covering is formulated to be degradable within a particular temperature range to meet the required application or downhole temperature at the required period of time (e.g. hours or days) during run-in. The thickness of delay covering and the type of degradable plastics may be selected to be able to keep filtration devices of shape-memory polyurethane foam from expansion during run-in. Once the filtration device is in place downhole for a given amount of time at temperature, these degradable plastics decompose and which allows the filtration devices to expand to the inner wall of bore hole. In other words, the covering that inhibits or prevents the shape-memory porous material from returning to its expanded position or being prematurely deployed may be removed by dissolving, e.g. in an aqueous or hydrocarbon fluid, or by thermal degradation or hydrolysis, with or without the application of heat, in another non-limiting example, destruction of the crosslinks between polymer chains of the material that makes up the covering.

The polyurethane foam material may be formed by combining two separate portions of chemical reactants and reacting them together. These two separate portions are referred to herein as the isocyanate portion and polyol portion. The isocyanate portion may comprise a modified isocyanate (MI) or a modified diphenylmethane diisocyanate (MDI) based monomeric diisocyanate or polyisocyanate. The polyol portion may include, but not necessarily be limited to, a polyether, polyester or polycarbonate-based di- or multifunctional hydroxyl-ended prepolymer.

Water may be included as part of the polyol portion and may act as a blowing agent to provide a porous foam structure when carbon dioxide is generated from the reaction with the isocyanate and water when the isocyanate portion and the polyol portion are combined.

In one non-restrictive embodiment, the isocyanate portion may contain modified MDI MONDUR PC sold by Bayer or MDI prepolymer LUPRA-NATE 5040 sold by BASF, and the polyol portion may contain (1) a poly(cycloaliphatic carbonate) polyol sold by Stahl USA under the commercial name PC-1667; (2) a tri-functional hydroxyl cross linker trimethylolpropane (TMP) sold by Alfa Aesar; (3) an aromatic diamine chain extender dimethylthiotoluenediamine (DMTDA) sold by Albemarle under the commercial name ETHACURE 300; (4) a catalyst sold by Air Products under the commercial name POLYCAT 77; (5) a surfactant sold by Air Products under the commercial name DABCO DC198; (6) a cell opener sold by Degussa under the commercial name ORTEGOL 501, (7) a colorant sold by Milliken Chemical under the commercial name REACTINT Violet X80LT; and (8) water.

The ratio between two separate portions of chemical reactants which are referred to herein as the isocyanate portion and polyol portion may, in one non-limiting embodiment, be chemically balanced close to 1:1 according to their respective equivalent weights. The equivalent weight of the isocyanate portion is calculated from the percentage of NCO (isocyanate) content which is referred to herein as the modified MDI MONDUR PC and contains 25.8% NCO by weight. Other isocyanates such as MDI prepolymer Lupranate 5040 sold by BASF contains 26.3% NCO by weight are also acceptable. The equivalent weight of the polyol portion is calculated by adding the equivalent weights of all reactive components together in the polyol portion, which includes polyol, e.g., PC-1667, water, molecular cross linker, e.g., TMP, and chain extender, e.g., DMTDA. The glass transition temperature of the finished polyurethane foam may be adjustable via different combinations of isocyanate and polyol. In general, the more isocyanate portion, the higher the $T_g$ that is obtained.

The chain extender, dimethylthiotoluenediamine (DMTDA) sold by Albemarle under the commercial name ETHACURE 300, is a liquid aromatic diamine curative that provides enhanced high temperature properties. Other suitable chain extenders include but are not limited to 4,4'-Methylene bis (2-chloroaniline), "MOCA", sold by Chemtura under the commercial name VIBRACURE® A 133 HS, and trimethylene glycol di-p-aminobenzoate, "MCDEA", sold by Air Products under the commercial name VERSALINK 740M. In certain embodiments, either amine-based or metal-based catalysts are included to achieve good properties of polyurethane foam materials. Such catalysts are commercially available from companies such as Air Products. Suitable catalysts that provide especially good properties of polyurethane foam materials include, but are not necessarily limited to, pentamethyldipropylenetriamine, an amine-based catalyst sold under the commercial name POLYCAT 77 by Air Products, and dibutyltindilaurate, a metal-based catalyst sold under the commercial name DABCO T-12 by Air Products.

A small amount of surfactant, e.g., 0.5% of total weight, such as the surfactant sold under the commercial name DABCO DC-198 by Air Products and a small amount of cell opener, e.g., 0.5% of total weight, such as the cell opener sold under the commercial names ORTEGOL 500, ORTEGOL 501, TEGOSTAB B8935, TEGOSTAB B8871, and TEGOSTAB B8934 by Degussa may be added into the formulations to control foam cell structure, distribution and openness. DABCO DC-198 is a silicone-based surfactant from Air Products. Other suitable surfactants include, but are not necessarily limited to, fluorosurfactants sold by DuPont under commercial names ZONYL 8857A and ZONYL FSO-100. Colorant may be added in the polyol portion to provide desired color in the finished products. Such colorants are commercially available from companies such as Milliken Chemical which sells suitable colorants under the commercial name REACTINT.

After the isocyanate portion and the polyol portion are prepared, they are combined or mixed together at a desired temperature. The temperature at which the two portions are combined affects the degree of cell size within the resultant polyurethane foam material. For example, higher temperatures of the mixture provide larger cell size while lower temperatures of the mixture provide smaller cell size.

In one particular, but non-restrictive embodiment, the polyol portion including poly(cycloaliphatic carbonate) and other additives such as cross linker, chain extender, surfactant, cell opener, colorant, water, and catalyst is pre-heated to 90° C. before being combined with the isocyanate portion. The isocyanate portion is combined with the polyol portion and a foaming reaction is immediately initiated and the mixture's viscosity increases rapidly.

Due to the high viscosity of the mixture and the fast reaction rate, a suitable mixer is recommended to form the polyurethane foam material. Although there are many commercially available fully automatic mixers specially designed for two-part polyurethane foam processing, it is found that mixers such as KITCHENAID® type mixers with single or double blades work particularly well. In large-scale mixing, eggbeater mixers and drill presses have been found to work particularly well.

In mixing the isocyanate and polyol portions, the amount of isocyanate and polyol included in the mixture should be chemically balanced according to their equivalent weight. In one specific non-limiting embodiment, 5% more isocyanate by equivalent weight is combined with the polyol portion.

In one embodiment, the ratio between isocyanate and polycarbonate polyol is about 1:1 by weight. The polyol portion may be formed by 46.0 g of PC-1667 poly(cycloaliphatic carbonate) polycarbonate combined with 2.3 g of TMP cross-linker, 3.6 g of DMTDA chain extender, 0.9 g DABCO DC-198 surfactant, 0.4 g of ORTEGOL 501 cell opener, 0.1 g of REACTINT Violet X80LT colorant, 0.01 g of POLYCAT 77 catalyst, and 0.7 g of water blowing agent to form the polyol portion. The polyol portion is preheated to 90° C. and mixed in a KITCHENAID® type single blade mixer with 46.0 g of MDI MONDUR PC. As will be recognized by persons of ordinary skill in the art, these formulations can be scaled-up to form larger volumes of this shape-memory material.

The mixture containing the isocyanate portion and the polyol portion may be mixed for about 10 seconds and then poured into a mold and the mold immediately closed by placing a top metal plate thereon. Due to the significant amount pressure generated by foaming process, a C-clamp may be used to hold the top metal plate and mold together to prevent any leakage of mixture. After approximately 2 hours at room temperature, the polyurethane foam material including a mold and a C-clamp may be placed inside an oven and "post-cured" at a temperature of 110° C. for approximately 8 hours so that the polyurethane foam material reaches its full strength. After cooled down to room temperature, the polyurethane foam material is sufficiently cured such that the mold may be removed. Thereafter, the polyurethane foam material at this stage will, almost always, include a layer of "skin" on the outside surface of the polyurethane foam. The "skin" is a layer of solid polyurethane plastic formed when the mixture contacts with the mold surface. It has been found that the thickness of the skin depends on the concentration of water added to the mixture. Excess water content decreases the thickness of the skin and insufficient water content increases the thickness of the skin. In one non-limiting explanation, the formation of the skin is believed to be due to the reaction between the isocyanate in the mixture and the moisture on the mold surface. Therefore, additional mechanic conversion processes are needed to remove the skin, since in most cases the skin is not porous to the passage of fluids therethrough. Tools such as band saws, miter saws, core saws, hack saws and lathes may be used to remove the skin. After removing the skin from the polyurethane foam material, it will have a full open cell structure, that is, rigid, strong and tough.

At this point, the polyurethane foam material is in its original, expanded shape having an original, or expanded, thickness. The $T_g$ of the polyurethane foam material is measured by Dynamic Mechanical Analysis (DMA) as 94.4° C. from the peak of loss modulus, G". The polyurethane foam material may be capable of being mechanically compressed to at least 25% of original thickness or volume at temperature 125.0° C. in a confining mold. While still in the compressed state, the material is cooled down to room temperature. The shape-memory polyurethane foam is able to remain in the compressed state even after applied mechanical force is removed. When the material is heated to about 88° C., in one non-restrictive version, it is able to return to its original shape within 20 minutes. However, when the same material is heated to about 65° C. for about 40 hours, it does not expand or change its shape at all.

In another non-limiting embodiment, the ratio between isocyanate and polycarbonate polyol is about 1.5:1 by weight. The polyol portion may be formed by 34.1 g of PC-1667 poly(cycloaliphatic carbonate) polycarbonate combined with 2.3 g of TMP cross linker, 10.4 g of DMTDA chain extender, 0.8 g DABCO DC-198 surfactant, 0.4 g of ORTEGOL 501 cell opener, 0.1 g of REACTINT Violet X80LT colorant, 0.01 g of POLYCAT 77 catalyst, and 0.7 g of water blowing agent to form the polyol portion. The polyol portion is preheated to 90° C. and mixed in a KITCHENAID® type single blade mixer with 51.2 g of MDI MONDUR PC. As will be recognized by persons of ordinary skill in the art, these formulations can be scaled-up to form larger volumes of this shape-memory material.

The mixture containing the isocyanate portion and the polyol portion may be mixed for about 10 seconds and then poured into a mold and the mold immediately closed by placing a top metal plate thereon. Due to the significant amount pressure generated by foaming process, a C-clamp or other device may be used to hold the top metal plate and mold together to prevent any leakage of mixture. After approximately 2 hours, the polyurethane foam material including a mold and a C-clamp may be transferred into an oven and "post-cured" at a temperature of 110° C. for approximately 8 hours so that the polyurethane foam material reaches its full strength. After cooled down to room temperature, the polyurethane foam material is sufficiently cured such that the mold can be removed.

The $T_g$ of this polyurethane foam material may be measured as 117.0° C. by DMA from the peak of loss modulus, G".

As may be recognized, the polyurethane foam having more isocyanate than polyol by weight results in higher glass transition temperature. The polyurethane foam having less isocyanate than polyol by weight results in lower $T_g$. By formulating different combinations of isocyanate and polyol, different glass transition temperatures of shape-memory polyurethane foam may be achieved. Compositions of a shape-memory polyurethane foam material having a specific $T_g$ may be formulated based on actual downhole deployment/application temperature. Usually, the $T_g$ of a shape-memory polyurethane foam is designed about 20° C. higher than actual downhole deployment/application temperature. Because the application temperature is lower than $T_g$, the material retains good mechanical properties.

In one non-restrictive embodiment, the shape-memory polyurethane foam in tubular shape may be compressed under hydraulic pressure above glass transition temperature, and then cooled to a temperature well below the $T_g$ or room temperature while it is still under compressing force. After the pressure is removed, the shape-memory polyurethane foam is able to remain at the compressed state or shape. The tubular compressed shape-memory polyurethane material may then be tightly wrapped with (PVA) film commercially available from Idroplax, S.r.l., Italy, under the commercial name HT-350, in one non-limiting embodiment. In another non-restrictive embodiment, the tubular compressed shape-memory polyurethane material may be roll-coated with a layer of thermally fluid-degradable polyurethane resin which is formed by combining 70 parts, by weight, of liquid isocyanate such as MONDUR PC from Bayer and 30 parts, by weight, liquid polyester polyol such as FOMREZ 45 from Chemtura. In another non-limiting embodiment, the tubular compressed shape-memory polyurethane foam material may be dipped inside a pan containing the liquid polyurethane mixture while it is slowly rotating. Within about 5 minutes, a layer of polyurethane coating about 1.5 mm thick will be built up. Such a polyurethane coating may be cured at room temperature for about 8 hours. In one non-restrictive version, it is helpful if the material remains rotating while it is under curing process to avoid any dripping of resin. About 0.1% catalyst such as POLYCAT 77 from Air Products may be added in the polyurethane mixture to accelerate curing process.

With reference to FIGS. 1 and 2, in operation, the tubing string 20 having filtration device 30 including a shape-memory porous material 32 is run-in wellbore 50, which is defined by wellbore casing 52, to the desired location. As shown in FIG. 1, shape-memory material 32 has a compressed, run-in, thickness 34, and an outside delay film, covering or coating 40. After a sufficient amount of delaying film, covering or coating material 40 is dissolved or de-composed, i.e., after the delaying film, covering or coating material 40 is dissolved or decomposed such that the stored energy in the compressed shape-memory material 32 is greater than the compressive forces provided by the delaying material, shape-memory porous material 32 expands from the run-in or compressed position (FIG. 1) to the expanded or set position (FIG. 2) having an expanded thickness 36. In so doing, shape-memory material 32 engages with inner wall surface 54 of wellbore casing 52, and, thus, prevents the production of undesirable solids from the formation, allows only hydrocarbon fluids flow through the filtration device 30.

Further, when it is described herein that the filtration device "totally conforms" to the borehole, what is meant is that the shape-memory porous material expands or deploys to fill the available space up to the borehole wall. The borehole wall will limit the final, expanded shape of the shape-memory porous material and in fact not permit it to expand to its original, expanded position or shape. In this way however, the expanded or deployed shape-memory material, being porous, will permit hydrocarbons to be produced from a subterranean formation through the wellbore, but will prevent or inhibit small or fine solids from being produced since they will generally be too large to pass through the open cells of the porous material.

It is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims. Further, the specification is to be regarded in an illustrative rather than a restrictive sense. For example, specific combinations of components to make the polyurethane/urea thermoplastic, specific downhole tool configurations and other compositions, components and structures falling within the claimed parameters, but not specifically identified or tried in a particular method or apparatus, are anticipated to be within the scope of this invention.

The terms "comprises" and "comprising" in the claims should be interpreted to mean including, but not limited to, the recited elements.

The present invention may suitably comprise, consist or consist essentially of the elements disclosed and may be practiced in the absence of an element not disclosed.

What is claimed is:

1. A method of manufacturing a wellbore filtration device, the method comprising:

(a) mixing an isocyanate portion comprising an isocyanate with a polyol portion comprising a polyol to form an open-cell polyurethane foam material having an original expanded volume;

(b) compressing the polyurethane foam material at a temperature above its glass transition temperature $T_g$ to reduce the original expanded volume to a compressed run-in volume;

(c) lowering the temperature of the compressed polyurethane foam material to a temperature below $T_g$ where the polyurethane foam material maintains the compressed run-in volume; and (d) covering an outer surface of the compressed polyurethane foam material with a covering selected from the group consisting of a fluid-dissolvable polymeric film, a layer of thermally fluid-degradable plastic, and a combination thereof.

2. The method of claim 1, wherein the polyol portion comprises a mixture of polyol and water.

3. The method of claim 1 where the polyol portion comprises a polycarbonate polyol.

4. The method of claim 1, wherein the polyol portion comprises a chain extender.

5. The method of claim 4, wherein the chain extender comprises an aromatic diamine.

6. The method of claim 1, wherein the polyol portion comprises water, a chain extender and a catalyst selected from the group consisting of amine-based catalysts, metal-based catalysts and mixtures thereof.

7. The method of claim 1, wherein the polyol portion comprises water, a chain extender, a catalyst, and a surfactant.

8. The method of claim 7, wherein the surfactant further comprises a cell opener.

9. The method of claim 1, wherein the polyol portion is preheated to at least 90° C. prior to being combined with the isocyanate portion.

10. The method of claim 1, wherein step (a) further comprises curing the polyurethane foam material in a mold and then heating the polyurethane foam material at a temperature greater than 110° C.

11. The method of claim 1, wherein step (a) comprises mixing equivalent weights of the isocyanate portion and the polyol portion.

12. The method of claim 1, wherein step (a) comprises mixing the isocyanate portion and the polyol portion in a mixer for at least about 10 seconds and curing the polyurethane foam material in a mold at room temperature for at least about 2 hours.

13. The method of claim 12, wherein step (a) further comprises, after curing the polyurethane foam material, heating the polyurethane foam material at a temperature of at least about 110° C. for at least about 8 hours.

14. A method of manufacturing a wellbore filtration device, the method comprising:

(a) mixing equivalent weights of an isocyanate portion comprising an isocyanate with a polyol portion comprising a polycarbonate polyol to form an open-cell polyurethane foam material having an original expanded volume;

(b) compressing the polyurethane foam material at a temperature above its glass transition temperature $T_g$ to reduce the original expanded volume to a compressed run-in volume;

(c) lowering the temperature of the compressed polyurethane foam material to a temperature below $T_g$ where the polyurethane foam material maintains the compressed run-in volume; and (d) covering an outer surface of the compressed polyurethane foam material with a covering selected from the group consisting of a fluid-dissolvable polymeric film, a layer of thermally fluid-degradable plastic, and a combination thereof.

15. The method of claim 14, wherein the polycarbonate polyol portion comprises a mixture of polyol and water.

16. The method of claim 14, wherein the polycarbonate polyol portion comprises a chain extender.

17. The method of claim 16, wherein the chain extender comprises an aromatic diamine.

18. The method of claim 14, wherein the polycarbonate polyol portion comprises water, a chain extender and a catalyst selected from the group consisting of amine-based catalysts, metal-based catalysts and mixtures thereof.

19. The method of claim 14, wherein step (a) further comprises curing the polyurethane foam material in a mold and then heating the polyurethane foam material at a temperature greater than 110° C.

* * * * *